US009771936B2

(12) United States Patent
Hirono et al.

(10) Patent No.: US 9,771,936 B2
(45) Date of Patent: Sep. 26, 2017

(54) GAS COMPRESSOR

(71) Applicant: CALSONIC KANSEI CORPORATION, Saitama (JP)

(72) Inventors: Kouji Hirono, Saitama (JP); Hirotada Shimaguchi, Saitama (JP); Masahiro Tsuda, Saitama (JP); Shizuma Kaneko, Saitama (JP); Tatsuya Osaki, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 21 days.

(21) Appl. No.: 14/404,720

(22) PCT Filed: May 30, 2013

(86) PCT No.: PCT/JP2013/065098
§ 371 (c)(1),
(2) Date: Dec. 1, 2014

(87) PCT Pub. No.: WO2013/183545
PCT Pub. Date: Dec. 12, 2013

(65) Prior Publication Data

US 2015/0147213 A1 May 28, 2015

(30) Foreign Application Priority Data

Jun. 5, 2012 (JP) ..... 2012-127730

(51) Int. Cl.
*F03C 2/30* (2006.01)
*F04C 2/344* (2006.01)
(Continued)

(52) U.S. Cl.
CPC ..... *F04C 15/06* (2013.01); *F01C 21/106* (2013.01); *F04C 2/08* (2013.01); *F04C 18/3441* (2013.01);
(Continued)

(58) Field of Classification Search
CPC ..... F01C 21/106; D04C 15/06; F04C 29/12; F04C 2250/102
(Continued)

(56) References Cited

U.S. PATENT DOCUMENTS 3,620,654 A * 11/1971 Allen ..... F04C 27/001 418/125
3,652,191 A * 3/1972 King ..... F04C 27/001 418/125
(Continued)

FOREIGN PATENT DOCUMENTS

CN 2471972 1/2002
CN 102365461 2/2012
(Continued)

OTHER PUBLICATIONS

International Search Report (ISR) issued Aug. 27, 2013 in International (PCT) Application No. PCT/JP2013/065098.

*Primary Examiner* — Mark Laurenzi
*Assistant Examiner* — Deming Wan
(74) *Attorney, Agent, or Firm* — Wenderoth, Lind & Ponack, L.L.P.

(57) ABSTRACT

A gas compressor includes at least two first and second discharge ports (45*a*, 45*b*) which are provided at an upstream side in a rotation direction of a rotor (50) along a peripheral direction of an inner peripheral surface 40*a* of a cylinder (40) with respect to a closest area (proximity part (48)) where the inner peripheral surface (40*a*) of the cylinder (40) and an outer peripheral surface (50*a*) of the rotor (50) are closest in a range of one revolution of a rotation shaft (51) and configured to discharge the refrigerant gas compressed in compression chambers (43). Of the first and second discharge ports (45*a*, 45*b*), on only the first discharge port (45*a*) closest to the proximity part (48), a cutout groove
(Continued)

portion (47) is provided at a downstream-side edge portion of the first discharge port (45*a*) in the rotation direction of the rotor (50).

10 Claims, 3 Drawing Sheets

(51) Int. Cl.

| | |
|---|---|
| ***F01C 21/18*** | (2006.01) |
| ***F04C 18/344*** | (2006.01) |
| ***F04C 15/06*** | (2006.01) |
| ***F04C 29/12*** | (2006.01) |
| ***F01C 21/10*** | (2006.01) |
| ***F04C 2/08*** | (2006.01) |

(52) U.S. Cl.
CPC ..... *F04C 29/12* (2013.01); *F04C 2250/102* (2013.01)

(58) Field of Classification Search
USPC ..... 418/83, 259, 15, 270, DIG. 1
See application file for complete search history.

(56) References Cited

U.S. PATENT DOCUMENTS

| | | | | |
|---|---|---|---|---|
| 3,865,515 | A * | 2/1975 | Allen | F01C 21/10 417/283 |
| 3,890,071 | A * | 6/1975 | O'Brien | F01C 1/3441 418/150 |
| 4,342,547 | A | 8/1982 | Yamada et al. | |
| 4,410,305 | A * | 10/1983 | Shank | F01C 21/0836 418/150 |
| 2012/0076682 | A1 | 3/2012 | Sakakibara et al. | |

FOREIGN PATENT DOCUMENTS

| | | |
|---|---|---|
| JP | 54-81113 | 11/1977 |
| JP | 54-28008 | 3/1979 |
| JP | 55-98687 | 7/1980 |
| JP | 55-134786 | 10/1980 |
| JP | 59-96496 | 6/1984 |
| JP | 2004-27920 | 1/2004 |

* cited by examiner

GAS COMPRESSOR

TECHNICAL FIELD

The present invention relates to a gas compressor, and more specifically, to an improvement in a gas compressor of a vane rotary type.

BACKGROUND ART

For example, a vehicle such as an automobile is provided with an air conditioner to perform temperature adjustment in a vehicle interior. Such an air conditioner includes a loop-like refrigerant cycle to circulate a refrigerant (cooling medium). The refrigerant cycle is provided with an evaporator, a compressor, a condenser and an expansion valve which are arranged in order.

The compressor of the air conditioner compresses a gas-like refrigerant (refrigerant gas) evaporated by the evaporator to form a high-pressure refrigerant gas and sends it to the condenser.

A vane rotary type compressor is conventionally known as an example of the gas compressor (for reference, see Patent Literature 1). In the vane rotary type compressor, a rotor having a plurality of vanes is rotatably disposed in a cylinder having a generally elliptic inner peripheral surface. The vanes are provided in the rotor to be movable in a radial direction of the rotor, and are configured such that a leading end portion of each vane is in slide-contact with the inner peripheral surface of the cylinder.

The vane rotary type compressor includes compression chambers each having a capacity changed by the slide-contact of the vanes with the inner peripheral surface of the cylinder as the vanes rotate in accordance with the rotation of the rotor. The compressor is configured to suck a refrigerant gas through a suction port as the capacity of each of the compression chambers increases, compress the sucked refrigerant gas as the capacity of each of the compression chambers decreases, and discharge the high-pressure refrigerant gas to a discharge chamber through a discharge port. Next, the compressor supplies the high-pressure refrigerant gas from the discharge chamber to a condenser side.

In addition, the vanes are slidably disposed in slit-shaped vane grooves extending from an inner side to an outer side of the rotor. Each of the vanes is moved by a back pressure (vane back pressure) of oil supplied to a bottom portion in the vane groove through a vane back pressure space and so on and by a centrifugal force of the rotating rotor such that a leading end portion of the vane projects from a surface of the rotor to maintain a state which is in contact with the inner peripheral surface of the cylinder.

RELATED ART

Patent Literature

Patent Literature 1: Japanese Patent Application Publication No. 54-28008

SUMMARY OF THE INVENTION

Technical Problem

By the way, in the vane rotary type compressor, excessive compression is easy to occur in each compression chamber since the refrigerant gas rapidly is compressed. Therefore, a large power loss and a large pressure difference between the adjacent compression chambers are generated in the compressor. As a result, there is generated a cause in that the refrigerant gas compressed from compression chambers in a downstream side of a rotation direction of the rotor to compression chambers in an upstream side of the rotation direction of the rotor is easy to leak from the compression chambers. For the cause, the vane rotary type compressor tends to have an efficiency (performance coefficient or COP (coefficient of Performance: cooling performance/power) lower than that of other type gas compressors (for example, a rotary piston type compressor and so on).

Therefore, the present invention is made in view of the foregoing problems, and an object of the present invention is to provide a gas compressor capable of preventing excessive compression from occurring in compression chambers.

Solution to Problem

To solve the foregoing problem, a gas compressor according to claim 1 includes a generally cylindrical rotor that rotates integrally with a rotational shaft; a cylinder including an inner peripheral surface having a contour shape surrounding an outer peripheral surface of the rotor; a plurality of plate-shaped vanes movably disposed in vane grooves formed in the rotor, the vane being projectable from the outer peripheral surface of the rotor to the inner peripheral surface of the cylinder, and the vanes forming a plurality of compression chambers which partition a space between the inner peripheral surface of the cylinder and the outer peripheral surface of the rotor, the contour shape of the cylinder being set such that the formed compression chambers perform by one cycle of suction, compression, and discharge of a medium during one revolution of the rotor; two side blocks that close both sides of each of the rotor and the cylinder; and at least two discharge ports configured to discharge the medium compressed in the compression chambers to an exterior. The discharge ports are provided at an upstream side in the rotation direction of the rotor along a peripheral direction of the inner peripheral surface of the cylinder with respect to a closest area where the inner peripheral surface of the cylinder and an outer peripheral surface of the rotor are closest in a range of one revolution of the rotational shaft. Of the discharge ports, on only the discharge port closest to the closest area, a cutout groove portion is provided at a downstream-side edge portion of the discharge port in the rotation direction of the rotor.

According to the gas compressor as recited in claim 2, the cutout groove portion extends from the downstream-side edge portion of the discharge port in the rotation direction of the rotor to the closest area side along the peripheral direction of the inner peripheral surface of the cylinder.

Advantageous Effects of the Invention

In the gas compressor according to the present invention, by providing the cutout groove portion at the downstream-side edge portion of only the discharge port of discharge ports, which is positioned at the closest side to the closest area where the inner peripheral surface of the cylinder and the outer peripheral surface of the rotor is closest in the downstream side of the rotation direction of the rotor, it is possible to discharge from the discharge port through the cutout groove portion a refrigerant gas accumulated in a micro sealed space formed between the inner peripheral surface of the cylinder and the outer peripheral surface of the rotor in an area between the downstream-side edge portion of the discharge port and the closest area along the rotation direction of the rotor. Thereby the refrigerant gas in the micro sealed space can be prevented from being excessively compressed and the power loss of the compressor can be inhibited.

DESCRIPTION OF THE EMBODIMENTS

Figure 1:
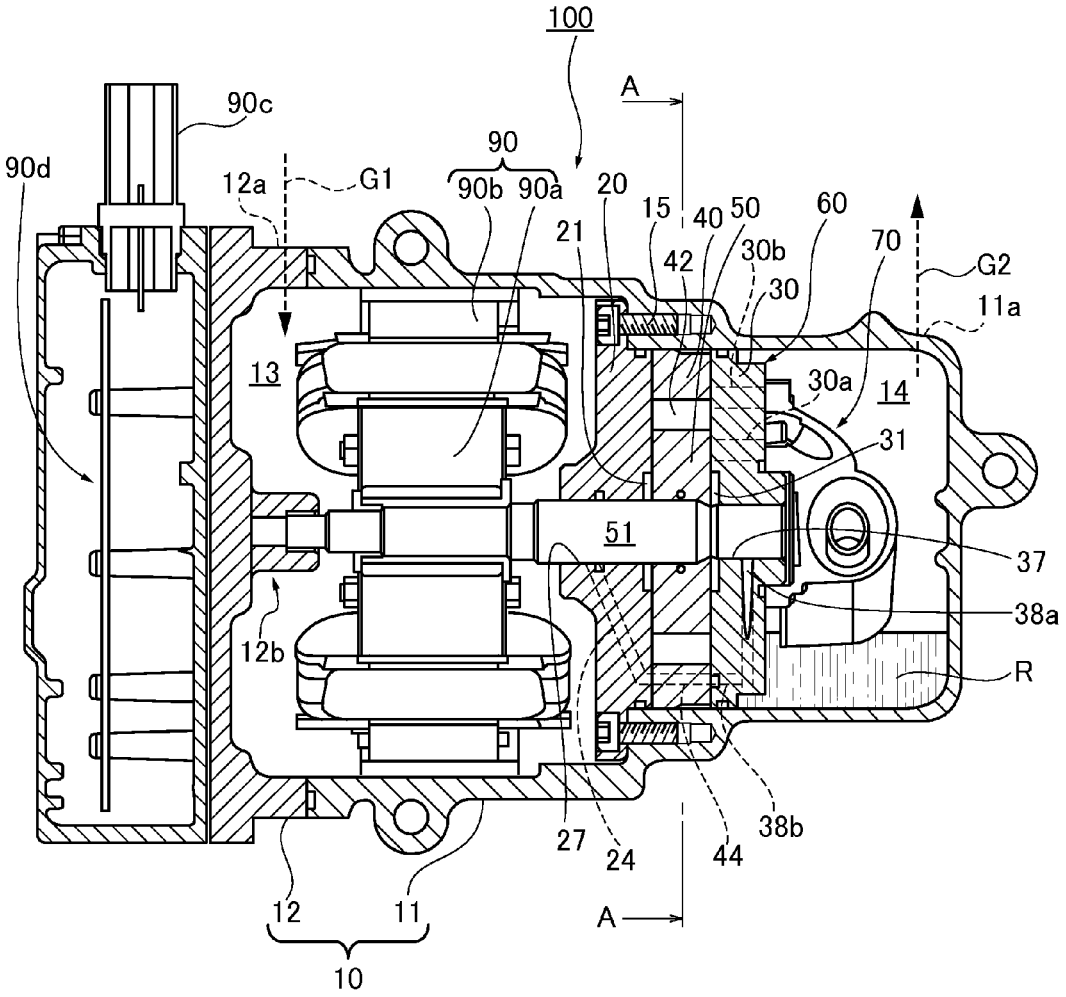
FIG. 1 is a longitudinal sectional view showing a vane rotary type gas compressor that is a gas compressor according to an embodiment of the present invention.
Figure 2:
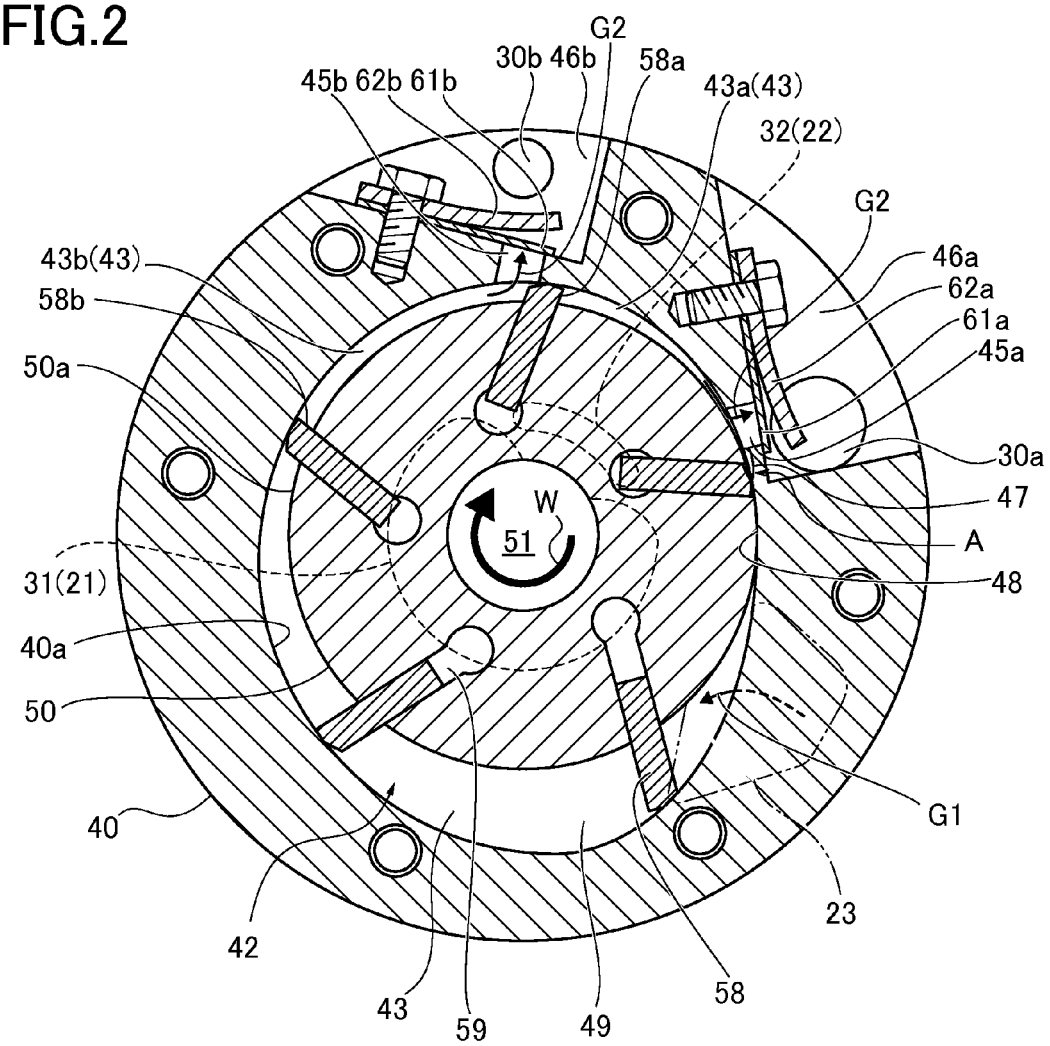
FIG. 2 is a cross sectional view taken along line A-A of FIG. 1.

The present invention will be explained hereinafter in accordance with embodiments made with reference to the accompanying drawings. FIG. 1 is a longitudinal sectional view showing a vane rotary type gas compressor (hereinafter, referred to as compressor) that is an embodiment of a gas compressor according to the present invention, and FIG. 2 is a cross sectional view taken along lines A-A of FIG. 1. Note that the compressor according to the embodiment is an electrical type compressor in which an electric motor is built.

(Entire Configuration and Operation of Compressor)

The illustrated compressor 100 is configured as a part of an air-conditioning system (hereinafter referred to as air conditioner) that executes cooling by use of vaporization heat of a cooling medium. The compressor is provided in a circulation path of the cooling medium together with a condenser, an expansion valve, an evaporator and so on (not shown) which are other components of the air conditioner. In addition, as such an air conditioner, for example, there is an air-conditioning device that performs temperature adjustment in a vehicle interior of a vehicle (automobile and so on).

The compressor 100 compresses a refrigerant gas as a gaseous cooling medium taken therein from the evaporator of the air conditioner and supplies the compressed refrigerant gas to the condenser of the air conditioner. The condenser liquefies the compressed refrigerant gas and sends the liquefied refrigerant gas under a high pressure to the expansion valve. The liquefied refrigerant under the high pressure is reduced in pressure by the expansion valve and supplied to the evaporator. The liquid refrigerant under a low pressure vaporizes by absorbing heat from circumambient air at the evaporator to cool air surrounding the evaporator by heat exchange of the vaporization heat from the air.

The compressor 100 has a configuration in which a motor 90 and a compressor body 60 are contained in a housing 10 mainly formed from a body case 11 and a front cover 12, as shown in FIG. 1.

The body case 11 has a generally cylindrical shape. One end (right side in FIG. 1) of the cylindrical shape is configured to be closed and the other end (left side in FIG. 1) of the cylindrical shape is configured to be opened.

The front cover 12 is formed in a lid-shaped structure to be in contact with the opened end of the body case 11 and close the opened end. In this state, the front cover 12 is fastened to the body case 11 by a fastening member to be integrated with the body case 11, thereby forming the housing 10 having a space therein.

The front cover 12 is provided with a suction port 12*a* that introduces the refrigerant gas G1 of the low pressure from the evaporator of the air conditioner in a suction chamber 13. On the other hand, a discharge chamber 14 of the body case 11 is provided with a discharge port 11*a* that discharges the refrigerant gas G2 of the high pressure acquired in the compressor body 60 into the condenser of the air conditioner. The discharge chamber 14 is described hereinafter.

The motor 90 provided inside the body case 11 configures a multiphase brushless direct current motor including a rotor 90*a* of a permanent magnet and a stator 90*b* of a permanent magnet. The stator 90*b* is fixed to the body case 11 by fitting in an inner peripheral surface of the body case 11. A rotational shaft 51 is fixed to the rotor 90*a*.

The motor 90 rotates the rotor 90*a* and the rotational shaft 51 about an axis thereof by exiting an electromagnet of the stator 90*b* by a power supplied through a power source connector 90*c* attached to an end surface of the front cover 12.

Note that a structure in which an inverter circuit 90*d* and so on are provided between the power source connector 90*c* and the stator 90*b* may be adopted.

Furthermore, the compressor 100 in the present embodiment is electrically operated as mentioned above. However, the gas compressor according to the present invention is not limited to this, may be mechanically operated. If the compressor 100 according to the present embodiment is mechanically operated, instead of providing the motor 90, there may be adopted a structure in which one end portion of the rotational shaft 51 is projected outward from the front cover 12 and a pulley, gear or the like receiving transmission of power from an engine and so on of the vehicle is attached to a leading end of the projected end portion of the rotational shaft 51.

The compressor body 60 and the motor 90 contained in the housing 10 are arranged side by side along a direction where the rotational shaft 51 extends, and the compressor body 60 is fixed to an inside of the body case 11 by a fastening member 15 such as bolts and so on.

The compressor body 60 includes the rotational shaft 51 rotated by the motor 90, a generally cylindrical rotor 50 rotating integrally with the rotational shaft 51, a cylinder 40 having an inner peripheral surface of an outline shape that surrounds an outer peripheral surface 50*a* (see FIG. 2) of the rotor 50, five plate-shaped vanes 58 which are provided to be capable of projecting from the outer peripheral surface 50*a* of the rotor 50 toward the inner peripheral surface 40*a* of the cylinder 40, and two side blocks (front side blocks 20 and rear side blocks 30) that close both ends of the rotor 50 and the cylinder 40.

The rotational shaft 51 is rotatably supported by a bearing 12*b* provided on the front cover 12 and bearings 27 and 37 respectively provided on the opposite side blocks 20 and 30 of the compressor body 60.

A seal member such as an O-ring and so on is provided on an outer peripheral surface of each of the front side block 20 and the rear side block 30 along the entirety of the outer peripheral surface. The seal member airtightly partitions the discharge chamber 14 formed in the body case 11 of the rear side block 30 side and the suction chamber 13 formed in the body case 11 between the front side block 20 and the front cover 12.

An oil separation unit 70 is positioned in the discharge chamber 14 and provided on an outer surface of the rear side block 30. Note that the motor 90 is provided in the suction chamber 13 formed in the front cover 12.

As shown in FIG. 2, a single cylinder chamber 42 is provided in the compressor body 60 among the inner peripheral surface 40*a* of the cylinder 40, the outer peripheral surface 50*a* of the rotor 50 and the both the side blocks 20, 30 (see FIG. 1).

Concretely, the outline shape of the inner peripheral surface of the cylinder 40 is set such that the inner peripheral surface 40*a* of the cylinder 40 and the outer peripheral surface 50*a* of the rotor 50 are approximately in contact or closest with each other at only one place (a proximity part 48 in FIG. 2) in an area of one revolution (angle of a 360-degree) of the rotational shaft 51. Consequently, the cylinder chamber 42 configures a single generally crescent-shaped space.

In addition, in the outline shape of the inner peripheral surface 40*a* of the cylinder 40, the proximity part 48 where the inner peripheral surface 40*a* of the cylinder 40 and the outer peripheral surface 50*a* of the rotor 50 are most close is set to a position separated by the angle of 270 degrees to a downstream direction along a direction W of rotation (clockwise direction) of the rotor 50 from a remote part 49 where the inner peripheral surface 40*a* of the cylinder 40 and the outer peripheral surface 50*a* of the rotor 50 are most remote.

The outline shape of the inner peripheral surface 40*a* of the cylinder 40 is set such that a distance between the outer peripheral surface 50*a* of the rotor 50 and the inner peripheral surface 40*a* of the cylinder 40 gradually decreases.

The vanes 58 are slidably fitted in vane grooves 59 formed in the rotor 50 and projected outward from the outer peripheral surface 50*a* of the rotor by a back pressure generated by oil from a refrigerator, which is supplied to the vane grooves 59.

In addition, the vanes 58 divide the single cylinder chamber 42 into a plurality of compression chambers 43. One compression chamber 43 is formed by the adjacent two vanes 58 along the rotation direction W of the rotor 50. Consequently, five compression chambers 43 are formed in the present embodiment in which the five vanes 58 are arranged at equal intervals of the angle of 72 degrees about the rotational shaft 51.

A capacity of each of the compression chambers 43 formed by partitioning the cylinder chamber 42 by the vanes 58 is gradually reduced as the compression chamber moves from the remote part 49 to the proximity part 48 along the rotation direction W.

A suction port 23 is provided in the front side block 20 at a position in a downstream side of the rotation direction of the rotor 50 with respect to the proximity part 48 of the cylinder chamber 42. The suction port is provided to communicate with the suction chamber 13.

On the other hand, first discharge port(s) 45*a* and second discharge port(s) 45*b* are provided in the inner peripheral surface 40*a* of the cylinder 40 along the inner peripheral surface of the cylinder 40 in an upstream side of the rotation direction of the rotor 50 with respect to the proximity part 48 of the cylinder chamber 42. In addition, the first discharge ports 45*a* are closer to the proximity part 48 with respect to the second discharge ports 45*b*. The second discharge ports 45*b* are disposed in the upstream side of the first discharge ports 45*a* along the rotation direction W of the rotor 50.

The first and second discharge ports 45*a* and 45*b* communicate with discharge chambers 46*a* and 46*b* as spaces formed in an outer peripheral surface of the cylinder 40 between the cylinder 40 and the body case 11, respectively. In addition, discharge passages 30*a* and 30*b* communicating between each of the discharge chambers 46*a*, 46*b* and the oil separation unit 70 attached to the outer surface of the rear side block 30 (surface facing the discharge chamber 14) are formed in the rear side block 30.

Figure 3:
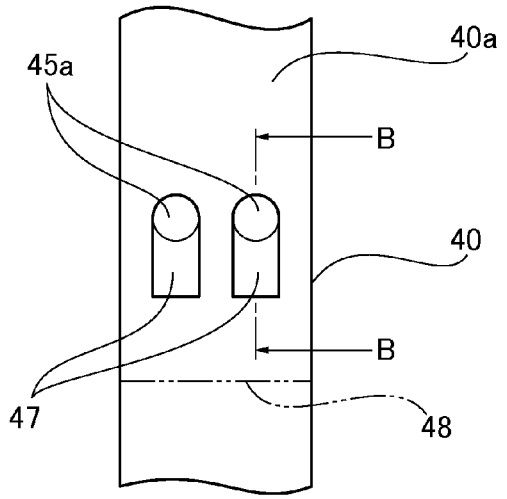
FIG. 3 is a view showing cutout groove portions extending from an edge portion of each of first discharge ports to a proximity part side along a peripheral direction of an inner peripheral surface of a cylinder.

As shown in FIG. 3, two first discharge ports 45*a* are formed in the inner peripheral surface of the cylinder 40 along a direction of width of the cylinder 40. Similarly, two second discharge ports 45*b* are formed along the direction of width of the cylinder. The first and second discharge ports 45*a* and 45*b* are mentioned hereinafter in detail.

The inner peripheral surface 40 is configured to have an outline shape such that only one cycle having the suction of the refrigerant gas passing through the suction port 23, the compression of the refrigerant gas and the discharge of the refrigerant gas from the first and second discharge ports 45*a*, 45*b* is achieved in each compression chamber 43 during a period of one rotation of the rotor 50.

The outline shape of the inner peripheral surface 40*a* of the cylinder 40 is set such that the interval between the inner peripheral surface 40*a* of the cylinder 40 and the outer peripheral surface 50*a* of the rotor 50 is rapidly large from a small value in the upstream side of the rotation direction of the rotor 50 with respect to the remote part 49 of the cylinder chamber 42. In an area of angle including the remote part 49, a stroke (suction stroke) is performed in which a volume of the compression chamber 43 increases as the rotor 50 rotates in the rotation direction W and a refrigerant gas G1 is sucked in the compression chamber 43 through the suction port 23.

Next, the outline shape of the inner peripheral surface 40*a* of the cylinder 40 is set such that the interval between the inner peripheral surface 40*a* of the cylinder 40 and the outer peripheral surface 50*a* of the rotor 50 becomes gradually small toward the downstream side of the rotation direction of the rotor 50 with respect to the remote part 49 of the cylinder chamber 42. In that area, the volume of the compression chamber 43 reduces in accordance with the rotation of the rotor 50, thereby the refrigerant gas in the compression chamber 43 is compressed (compression stroke).

When the interval between the inner peripheral surface 40*a* of the cylinder 40 and the outer peripheral surface 50*a* of the rotor 50 is further small in accordance with the rotation of the rotor 50, the refrigerant gas is further compressed. When a pressure of the refrigerant gas reaches a discharge pressure, a high-pressure refrigerant gas G2 is discharged from the first and second discharge ports 45*a* and 45*b* (discharge stroke).

In this way, as the rotor 50 rotates, each compression chamber 43 performs repeatedly the suction stroke, compression stroke and discharge stroke in this order, thereby a low-pressure refrigerant gas sucked in the compression chamber from the suction chamber 13 is converted into a high-pressure refrigerant gas, and the high-pressure refrigerant gas is discharged from the first and second discharge ports 45*a* and 45*b*.

Discharge valves 61*a*, 61*b* and valve supports 62*a*, 62*b* are provided about the first and second discharge ports 45*a*, 45*b*, respectively. The discharge valves resiliently deform to be bent toward the discharge chambers 46*a*, 46*b* to open the first and second discharge ports 45*a*, 45*b*, respectively, when the pressure of the refrigerant gas in the compression chamber 43 in the compression stroke is a predetermined pressure or more. When the pressure of the refrigerant gas does not reach the predetermined pressure, the discharge valves close the first and second discharge ports 45*a* and 45*b* by resilient forces of the discharge valves, respectively. The valve supports 62*a*, 62*b* prevent the discharge valves 61*a*, 61*b* from excessively bending toward the discharge chambers 46*a*, 46*b* side, respectively.

The oil separation unit 70 separates refrigerator oil mixed with the refrigerant gas from the refrigerant gas. Here, the refrigerant oil mixed with the refrigerant gas is a part of the refrigerator oil used for the back pressure of each vane, which is leaked from the vane grooves 59 formed in the rotor 50 into the cylinder chamber 42 (compression chambers 43). The oil separation unit is configured to centrifuge the refrigerator oil by spirally turning the high-pressure refrigerant gas which is discharged from the first and second discharge ports 45*a*, 45*b* and introduced in the oil separation unit through the discharge chambers 46*a*, 46*b* and the discharge passages 30*a*, 30*b*.

Then, the refrigerator oil R (see FIG. 1) separated from the refrigerant gas accumulates in a lower portion of the discharge chamber 14, and the high-pressure refrigerant gas G2 after the refrigerator oil R is separated is discharged from the discharge port 11*a* provided in an upper portion of the discharge chamber 14 and supplied to the condenser.

The refrigerator oil R accumulated in the lower portion of the discharge chamber 14 is, by a high-pressure atmosphere in the discharge chamber 14, supplied to each of the vane grooves 59 of the rotor 50 through an oil passage 38*a* and grooves 31 and 32 which are back-pressure forming concave portions formed in the rear side block 30, and the oil passage 38*a* and an oil passage 38*b* formed in the rear side block 30, an oil passage 44 formed in the cylinder 40, an oil passage 24 formed in the front side block 20 and grooves 21, 22 which are back-pressure forming concave portions formed in the front side block 20, thereby forming a back pressure that projects each vane 58 outward.

In addition, the refrigerator oil exudes from a clearance between each vane 58 and the vane groove 59, a clearance between the rotor 50 and each of the side blocks 20, 30 and so on to realize a function of lubrication and cooling in a contacting portion between the rotor 50 and each of the side blocks 20, 30, a contacting portion among the vanes 58, the cylinder 40 and each of the side blocks and so on. The separation of the refrigerator oil is performed by the oil separation unit 70 since a part of the refrigerator oil mixes with the refrigerant gas in each of the compression chambers 43.

Of the two grooves 31 and 32 formed in the rear side block 30, the refrigerator oil supplied to the groove 31 formed in a portion (portion corresponding to the suction stroke and the compression stroke) of the downstream side in the rotation direction W of the rotor 50 with respect to the proximity part 48 of the cylinder chamber 42 is supplied to the groove 31 passing through a narrow space between the bearing 37 and an outer peripheral surface of the rotational shaft 51 from the oil passage 38*a*. Consequently, the refrigerator oil has a middle pressure (pressure higher than the suction pressure which is the atmosphere in the suction chamber 13) lower than the high pressure (pressure close to the discharge pressure) which is the atmosphere in the discharge chamber 14 by the pressure loss of the oil when passing through the narrow space between the bearing 37 and the outer peripheral surface of the rotational shaft 51.

Of the two grooves 21 and 22 formed in the front side block 20, the refrigerator oil supplied to the groove 21 formed in a portion of the downstream side in the rotation direction of the rotor 50 with respect to the proximity part 48 of the cylinder chamber 42 has also a middle pressure similar to the refrigerator oil supplied to the groove 31.

On the other hand, of the two grooves 31 and 32 formed in the rear side block 30, the refrigerator oil supplied to the groove 32 formed in a portion (portion corresponding to the discharge stroke, mainly) of the upstream side in the rotation direction of the rotor 50 with respect to the proximity part 48 of the cylinder chamber 42 has a pressure (pressure higher than the middle pressure) close to the high pressure which is the atmosphere in the discharge chamber 14 since the refrigerator oil is supplied from the oil passage 38*a* without the pressure loss.

In addition, of the two grooves 21 and 22 formed in the front side block 20, the refrigerator oil supplied to the groove 22 formed in a portion of the upstream side in the rotation direction of the rotor 50 with respect to the proximity part 48 of the cylinder chamber 42 has also a high pressure similar to the refrigerator oil supplied to the groove 32.

Then, when the vane grooves 59 provided in the rotor 50 communicate with the grooves 21, 31, 22 and 32 of the side blocks 20, 30, respectively, in accordance with the rotation of the rotor 50, the refrigerator oil is supplied from each of the communicated grooves 21, 31, 22 and 32 to each of the vane grooves 59, thereby the pressure of the refrigerator oil forms the back pressure for projecting each of the vanes 58.

(Detailed Configuration of First and Second Discharge Ports 45*a* and 45*b*)

Next, the first and second discharge ports 45*a* and 45*b* formed in the inner peripheral surface 40*a* of the cylinder chamber 42 along a peripheral direction of the cylinder are described hereinafter in detail with reference to FIG. 2.

First, the first discharge port(s) 45*a* positioned at an upstream side close to the proximity part 48 along the rotation direction W of the rotor 50 corresponds to an original single discharge port in a gas compressor which has only the single discharge port and performs only one cycle of suction, compression and discharge during one rotation of the rotor 50, and can be referred to as a main discharge. On the other hand, the second discharge port 45*b* positioned at a further upstream side from the first discharge port 45*a* along the rotation direction W of the rotor 50 can be referred to as a sub-discharge port.

Then, when the refrigerant gas facing the first discharge ports 45*a* in accordance with the rotation of the rotor 50 becomes a high-pressure which is a predetermined pressure or more, the high-pressure refrigerant gas is discharged from the first discharge ports 45*a*. The high-pressure refrigerant gas G2 discharged from the first discharge ports 45*a* is introduced in the discharge chamber 14 passing the oil separation unit 70 through the discharge chamber 46*a* and the discharge passage 30*a*. At this time, the discharge valve 61*a* is resiliently deformed by the high-pressure refrigerant gas G2 discharged from the first discharge ports 45*a*, thus opening that discharge ports.

The compression chamber 43*b* adjacent to the compression chamber 43*a* in an upstream side of the compression chamber 43*a* along the rotation direction W of the rotor 50 has a volume larger than that of the compression chamber 43*a*, when the compression chamber 43*a* faces the first discharge ports 45*a*. A case in that the pressure of the refrigerant gas compressed in the compression chamber 43*b* reaches the predetermined pressure (predetermined discharge pressure) can occur before the compression chamber 43*b* reaches a position facing the first discharge ports 45*a*.

In this way, in a gas compressor in which only one of the discharge ports (only the first discharge ports 45*a*) is provided, the volume of the compression chamber 43*b* becomes further small in accordance with the rotation of the rotor 50.

Therefore, the pressure of the refrigerant gas in the compression chamber 43*b* exceeds the predetermined pressure (predetermined discharge pressure). However, the refrigerant gas exceeding the predetermined pressure (predetermined discharge pressure) is not discharged from the first discharge ports 45*a*, until the compression chamber 43*b* faces the first discharge ports.

As a result, when a force for pressing back the vane 58*b* a leading end of which being in contact with the inner peripheral surface of the cylinder from the cylinder 40 exceeds a pressing force to press the vane to the cylinder 40 by inner pressures of the compression chambers 43*a* and 43*b*, a chattering in that the projecting leading end of the vane 58*b* instantaneously separates from the inner peripheral surface 40*a* of the cylinder 40 may be generated. Here, the pressing force is a resultant force of a back pressure by the refrigerator oil from the vane groove 59 applied to the vane 58*b* positioned at the upstream side in the rotation direction, of the two vanes (the vanes 58*a*, 58*b* in FIG. 2) partitioning the compression chamber 43*b* and a centrifugal force acting to the vane 58*b*.

In contrast to this, the compressor 100 according the present embodiment as mentioned above includes the second discharge ports 45*b* which is provided in the upstream side of the first discharge ports 45*a* in the rotation direction of the rotor 50 and discharges the high-pressure refrigerant gas G2 in the compression chamber 43*b* when the pressure of the refrigerant gas in the compression chamber 43*b* reaches the predetermined pressure (predetermined discharge pressure) before the compression chamber faces the first discharge ports 45*a*.

Consequently, even if the pressure of the refrigerant gas in the compression chamber 43*b* reaches the predetermined pressure (predetermined discharge pressure) at a step before the refrigerant gas faces the first discharge ports 45*a*, the high-pressure refrigerant gas G2 in the compression chamber 43*b* is introduced in the discharge chamber 14 from the second discharge ports 45*b* passing through the oil separation unit 70 through the discharge chamber 46*b* and the discharge passage 30*b*. At this time, the discharge valve 61*b* opens by being resiliently deformed by the high-pressure refrigerant gas G2 discharged from the second discharge ports 45*b*.

In this way, the provision of the first and second discharge ports 45*a* and 45*b* formed at two places along the peripheral direction of the inner peripheral surface 40*a* of the cylinder 40 makes it possible to discharge the refrigerant gas in the compression chamber 43*b* from the second discharge ports 45*b* even if the pressure of the refrigerant gas in the compression chamber 43*b* reaches the predetermined pressure (predetermined discharge pressure) at the step before the refrigerant gas faces the first discharge ports 45*a*, thereby enabling preventing the pressure of the refrigerant gas from being excessively compressed so as to exceed the predetermined pressure (predetermined discharge pressure).

By the way, the high-pressure refrigerant gas G2 in the compression chamber 43*a* is discharged from the first discharge ports 45*a* and introduced in the discharge chamber passing the oil separation unit 70 through the discharge chamber 46*a* and the discharge passage 30*a*, during the operation of the compressor 100 as mentioned above. At this time, a micro sealed space having a small volume is formed between the inner peripheral surface 40*a* of the cylinder 40 and the outer peripheral surface 50*a* of the rotor 50, in an area between a downstream-side edge portion of each of the first discharge ports 45*a* and the proximity part 48 along the rotation direction W of the rotor 50. For the formation of the micro sealed space A, there is possibility that the high-pressure refrigerant gas is accumulated in the micro sealed space A.

Therefore, during the operation of the compressor 100, because the refrigerant gas accumulated in the micro sealed space A is excessively compressed, a power loss based on the excessive compression is generated in the compressor.

Figure 4:
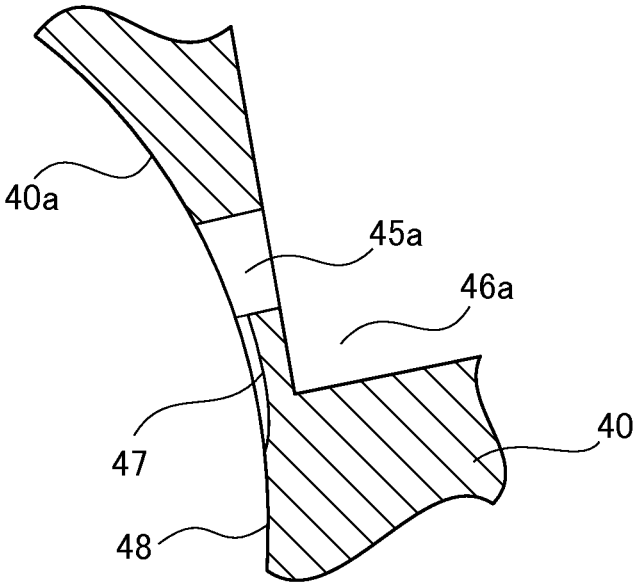
FIG. 4 is a cross sectional view taken along line B-B of FIG. 3.

To cope with this, the compressor 100 in the present embodiment is configured to have cutout groove portions 47 that are provided to extend from the downstream-side edge portion of each of the first discharge ports 45*a* in the rotation direction of the rotor 50 to the proximity part 48 side along the peripheral direction of the inner peripheral surface 40*a* of the cylinder 40, as shown in FIGS. 3 and 4. In other words, the cutout groove portions 47 are positioned at a vicinity of the micro sealed space. Here, FIG. 4 is a sectional view taken along line B-B of FIG. 3. Note that the discharge valve and the valve support disposed in the discharge chamber 46*a* of the cylinder 40 are not shown in FIG. 4.

Because one end side (opposite side to the proximity part 48) of each of the cutout groove portions 47 faces the edge portion of each of the first discharge ports 45*a*, the refrigerant gas accumulated in the micro sealed space is discharged from the first discharge ports 45 through the cutout groove portions 47. Note that the cutout groove portions are not provided at the second discharge ports 45*b* side.

In this way, because it is possible to discharge from the first discharge ports 45*a* through the cutout groove portions 47 the refrigerant gas accumulated in the micro sealed space which is formed between the inner peripheral surface 40*a* of the cylinder 40 and the outer peripheral surface 50*a* of the rotor 50 in the area between the downstream-side edge portion of each of the first discharge ports 45*a* and the proximity part 48 along the rotation direction W of the rotor 50, during the operation of the compressor 100, the refrigerant gas in the micro sealed space can be prevented from being excessively compressed and the power loss of the compressor can be inhibited.

CROSS-REFERENCE TO RELATED APPLICATION

This application claims priority from Japanese Patent Application No. 2012-127730 filed on Jun. 5, 2012, the disclosure of which is herein incorporated by reference.

DESCRIPTION OF REFERENCE NUMBERS

10: Housing
13: Suction chamber
14: Discharge chamber
20: Front side block
30: Rear side block
40: Cylinder
42: Cylinder chamber
43, 43*a*, 43*b*: Compression chamber
45*a*: First discharge port
45*b*: Second discharge port
47: Cutout groove portion
50: Rotor
51: Rotational shaft
58: Vanes
60: Compressor body
70: Oil separation unit
90: Motor
100: Compressor (Gas compressor)

The invention claimed is:

1. A gas compressor comprising:

a generally cylindrical rotor that rotates integrally with a rotational shaft;

a cylinder that includes an inner peripheral surface having a contour shape that surrounds an outer peripheral surface of the rotor;

a plurality of plate-shaped vanes movably disposed in vane grooves formed in the rotor, each vane of the vanes being projectable from the outer peripheral surface of the rotor to the inner peripheral surface of the cylinder, and the vanes forming a plurality of compression chambers which partition a space between the inner peripheral surface of the cylinder and the outer peripheral surface of the rotor, the contour shape of the cylinder being set such that the formed compression chambers perform by one cycle of suction, compression, and discharge of a medium during one revolution of the rotor;

two side blocks that close both sides of each of the rotor and the cylinder; and at least two discharge ports that discharge the medium compressed in the compression chambers to an exterior, wherein the at least two discharge ports are provided at an upstream side in the rotation direction of the rotor along a peripheral direction of the inner peripheral surface of the cylinder with respect to a closest area where the inner peripheral surface of the cylinder and the outer peripheral surface of the rotor are closest in a range of one revolution of the rotational shaft, wherein the contour shape of the inner peripheral surface of the cylinder is set such that the closest area is positioned at a downstream side with respect to a position opposite to a remote part in the rotational direction of the rotor where the inner peripheral surface of the cylinder and the outer peripheral surface of the rotor are most remote in the range of one revolution of the rotational shaft, across a rotational center of the rotor, wherein, of the at least two discharge ports, on only the discharge port closest to the closest area, a cutout groove portion is provided at a downstream-side edge portion of the discharge port closest to the closest area in the rotation direction of the rotor, wherein the cutout groove portion is formed to have a depth gradually decreasing from the downstream-side edge portion of the discharge port closest to the closest area to the downstream side in the rotation direction of the rotor, and wherein the cutout groove portion guides the medium accumulated in a micro sealed space formed between the inner peripheral surface of the cylinder and the outer peripheral surface of the rotor to the discharge port closest to the closest area in the rotation direction of the rotor.

2. The gas compressor according to claim 1, wherein the cutout groove portion extends from the downstream-side edge portion of the discharge port closest to the closest area in the rotation direction of the rotor to the closest area side along the peripheral direction of the inner peripheral surface of the cylinder.

3. The gas compressor according to claim 1, wherein the closest area is separated from the remote part by an angle of 270 degrees at the downstream side in the rotation direction of the rotor.

4. The gas compressor according to claim 3, wherein the cutout groove portion is provided at a vicinity of the micro sealed space formed between the inner peripheral surface of the cylinder and the outer peripheral surface of the rotor.

5. The gas compressor according to claim 3, wherein one end side of the cutout groove portion faces the downstream-side edge portion of the discharge port closest to the closest area, and the medium accumulated in the micro sealed space formed between the inner peripheral surface of the cylinder and the outer peripheral surface of the rotor is discharged from the discharge port closest to the closest area through the cutout groove portion.

6. The gas compressor according to claim 1, wherein the closest area is positioned between the position opposite to the remote part and the remote part along the rotation direction of the rotor, and wherein the closest area is equidistant from the remote part and the position opposite to the remote part.

7. The gas compressor according to claim 1, wherein the cutout groove portion does not extend past the downstream-side edge portion of the discharge port closest to the closest area into the discharge port closest to the closest area.

8. The gas compressor according to claim 1, wherein during operation of the gas compressor, the micro sealed space is formed between the inner peripheral surface of the cylinder and the outer peripheral surface of the rotor in an area between the downstream-side edge portion of the discharge port closest to the closest area and the closest area along the rotation direction of the rotor, and the medium accumulates in the micro sealed space.

9. The gas compressor according to claim 1, wherein the cutout groove portion is not provided at the upstream side in the rotation direction of the rotor along the peripheral direction of the inner peripheral surface of the cylinder with respect to the discharge port closest to the closest area.

10. The gas compressor according to claim 1, wherein the cutout groove portion is a groove portion that is a cutout from the inner peripheral surface of the cylinder.

* * * * *